United States Patent [19]

Beijer et al.

[11] 4,039,880

[45] Aug. 2, 1977

[54] METHOD OF OPERATING A SELF-STABILIZING DISCHARGE LAMP

[75] Inventors: Louis Benjamin Beijer; Mijndert Koedam; Jacobus Marinus Maria Claassens; Johannes Adrianus Josephus Maria Van Vliet, all of Eindhoven, Netherlands

[73] Assignee: U.S. Philips Corporation, New York, N.Y.

[21] Appl. No.: 642,068

[22] Filed: Dec. 18, 1975

[30] Foreign Application Priority Data

Jan. 17, 1975 Netherlands ..... 7500551

[51] Int. Cl.[2] ..... A47B 63/00; A47B 67/00

[52] U.S. Cl. ..... 313/183; 313/225; 315/358

[58] Field of Search ..... 313/198, 225, 183, 184, 313/220, 228; 315/116, 358

[56] References Cited

U.S. PATENT DOCUMENTS

| | | | |
|---|---|---|---|
| 3,248,590 | 4/1966 | Schmidt | 313/184 |
| 3,721,845 | 3/1973 | Cohen et al. | 313/15 |
| 3,757,158 | 9/1973 | Kopelman | 313/225 X |
| 3,898,504 | 8/1975 | Akutsu et al. | 313/220 |
| 3,900,753 | 8/1975 | Richardson | 313/225 X |

*Primary Examiner*—Rudolph V. Rolinec
*Assistant Examiner*—Vincent J. Sunderdick
*Attorney, Agent, or Firm*—Frank R. Trifari; Robert S. Smith

[57] ABSTRACT

The invention relates to a method of operating a self-stabilizing discharge lamp provided with a discharge tube which is filled with sodium and xenon.

According to the invention the discharge lamp is operated in such a manner that a sodium pressure is produced in the discharge space which results in a high luminous efficacy.

5 Claims, 2 Drawing Figures

METHOD OF OPERATING A SELF-STABILIZING DISCHARGE LAMP

The invention relates to a method of operating a self-stabilizing discharge lamp provided with a discharge tube whose filling mainly comprises sodium and xenon, defined in the operating condition by:

$$600 < P_{xenon}$$
$$\text{and } \frac{P_{sodium}}{P_{xenon}} \leqq \frac{1}{20}$$

where $P_{xenon}$ is the pressure in Torr of the xenon gas in the discharge tube and $P_{sodium}$ is the pressure in Torr of the sodium vapour in the discharge tube.

The invention also relates to a discharge lamp particularly suitable to be operated by such a method.

A known method of the kind mentioned above is described, for example, in Netherlands Patent Application 7,210,379. In this known method the discharge lamp operates in such a manner that the spectral distribution of the radiation emitted by the lamp is substantially equal to that obtained with a discharge in pure xenon gas. With such a spectral distribution proportionally much radiation is emitted at wavelengths to which the human eye is little sensitive. A drawback of this known method is therfore the low luminous efficacy of the lamp. The luminous efficacy is expressed, for example, in lumens per watt.

It is an object of the invention to provide a method of the kind described in the preamble, in which the advantage of the self-stabilizing operation is maintained i.e. operating the lamp without a ballast, while a spectral distribution of the emitted radiation is obtained which leads to a relatively large luminous efficacy.

According to the invention a method of operating a self-stabilizing discharge lamp provided with a discharge tube whose filling comprises sodium and xenon, defined in the operating condition by:

$$600 < P_{xenon}$$
$$\text{and } \frac{P_{sodium}}{P_{xenon}} \leqq \frac{1}{20}$$

where $P_{xenon}$ is the pressure in Torr of the xenon gas in the discharge tube and $P_{sodium}$ is the pressure in Torr of the sodium vapor in the discharge tube, and is characterized in that the discharge lamp is connected to an electrical supply source having an effective voltage value such that the temperature of the coldest spot in the discharge tube obtains an operating value of between 500° C and 675° C, and that sodium is present in an excess.

A temperature interval from 500° C to 675° C means that the sodium vapor pressure is located in a pressure range of between approximately 4 and 70 Torr.

An advantage of the method according to the invention is that the luminous efficacy of the lamp is large. This is caused by the fact that the spectral distribution of the emitted radiation of the lamp is that of a high-pressure sodium lamp. This is in contrast with that of lamps provided with a discharge tube comprising a combination of xenon gas and sodium vapor of a pressure which is lower than the pressure indicated; in fact, the latter lamps mainly exhibit a xenon spectrum.

In this connection it is to be noted that the spectral distribution of a high-pressure sodium lamp and hence that of a lamp according to the invention is to a large extent concentrated near the wavelength of approximately 5900 Angstrom at which the sensitivity of the human eye is substantially at a maximum.

$$\text{The ratio } \frac{P_{sodium}}{P_{xenon}} \leqq \frac{1}{20}$$

is a known requirement to operate the discharge lamp without a ballast, that is to say, without a separate stabilizing element. In that case also the reignition peak required for the lamp, in case of alternating current supply, is not so pronounced. Of course - when operating at an alternating current - an alternating supply voltage must be used having such an amplitude that both the said temperature of the coldest spot in the discharge tube is realized and that the required reignition voltage of the lamp is exceeded by this supply voltage.

To start the lamp for which the temperature of the coldest spot in the discharge tube is to be brought to a value of more than the said 500° C, an auxiliary apparatus is usually required, for example, a known ballast or a heating member.

It is to be noted that a discharge lamp provided with a discharge tube comprising sodium and xenon exhibiting a spectral distribution of the emitted radiation which is characteristic of a highpressure sodium vapor discharge lamp is known per se from U. S. Pat. No. 3,248,590. However, said U. S. Pat. does not provide any information on the possibility of operating said lamp without a ballast.

For the purpose of explaining the requirements to be satisfied by the discharge lamp according to the invention it is to be noted that a temperature of 500° C at the coldest spot in the discharge tube corresponds to a sodium vapor pressure of approximately 4 Torr. A temperature of 675° C of that spot corresponds to a sodium vapor pressure of approximately 70 Torr. The condition that the xenon pressure in the operating condition is to be more than 600 Torr of course implies that the xenon pressure at room temperature (approximately 300° Kelvin) is to be more that $300/T$. 600 Torr = $(18.10^4/T$ Torr where $T$ is the mean temperature - in degrees Kelvin - of the discharge tube in the operating condition.

A discharge tube comprising inter alia sodium as a filling and in which the temperature is more than 500° C is generally provided with a wall of a sodium-resistant material, for example, polycrystalline aluminium oxide or sapphire. As a rule these discharge tubes have an elongated shape with an electrode being provided at both ends of the discharge tube.

If in case of a given effective value of the electrical supply voltage the temperature of the coldest spot in the discharge tube were beyond the said interval of from 500° C to 675° C, different steps could be used to satisfy this condition, for example, the distance between the top of the electrode and the adjacent internal end of the discharge tube may be changed, or the length of the discharge tube may be modified, etc.

In a preferred embodiment of a discharge lamp according to the invention in which said lamp is provided with an elongated discharge tube whose filling mainly comprises sodium and xenon gas and in which an electrode is provided near each of the two ends of the discharge tube, a member influencing the temperature is provided at the area of the coldest spot in the operating condition of the discharge tube.

The member influencing the temperature may be, for example, a heat shield for increasing the temperature or a cooling member, for example, a cooling ring or cooling fin for decreasing the temperature of the coldest spot in the discharge tube.

An advantage of this preferred embodiment is that accurate adjustment of the temperature of the coldest spot in the discharge tube is possible even after gastight sealing of the discharge tube.

In a further improvement of the latter preferred embodiment of a discharge lamp according to the invention the coldest spot and at least part of the member influencing the temperature are present behind an electrode in the operating condition of the lamp.

An advantage of this further improvement is that the member influencing the temperature is present at an area which is not very disturbing for the radiation of light.

The invention will be described in greater detail with reference to a drawing in which.

Figure 1:
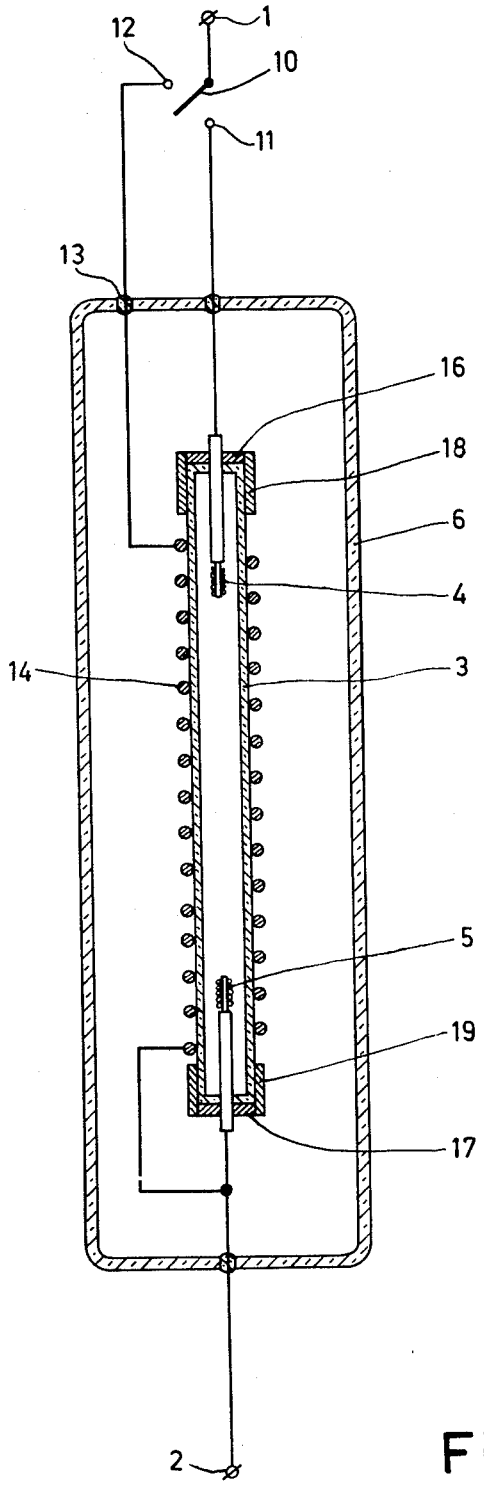
FIG. 1 shows a self-stabilizing discharge lamp according to the invention and a connection of this lamp to a supply mains.

In FIG. 1 the reference numberals 1 and 2 denote connection terminals which are intended to be connected to a supply mains of 38 Volt, 50 Herz. The reference numeral 3 denotes a discharge tube whose wall consists of polycrystalline aluminium oxide. The elongated tube 3 has at both ends an electrode 4 and 5 respectively. The discharge tube 3 is present within an outer envelope 6. The lever contact of a switch 10 is connected to the terminal 1. A fixed contact 11 of the switch 10 is connected to the electrode 4 of the discharge tube 3. A further fixed contact 12 of the switch 10 is connected to an electrical lead-through 13 of the outer envelope 6. The other side if this lead-through is connected to a heating filament 14 wound about the discharge tube 3. The other side of this heating filament, likewise as the electrode 5, is connected to terminal 2. Closing caps 16 and 17 of the discharge tube 3 are likewise made of polycrystalline aluminium oxide. The electrical lead-throughs from the discharge tube 3 to the electrodes 4 and 5 are connected in known manner by applying sealing glass to the polycrystalline aluminium oxide parts. See, for example, Netherlands Patent Application 6704681 for this purpose. Reference numerals 18 and 19 denote heat shields of tantalum.

In an embodiment the length of the lamp, that is to say of the envelope 6, is approximately 170 mm. The diameter of the envelope 6 is approximately 45 mm. The length of the discharge tube 3 is approximately 104 mm and its internal diameter is approximately 7.6 mm. The distance between the electrodes 4 and 5 is approximately 64 mm. The quantity of sodium in the discharge tube 3 is approximately 3 mg. The pressure of the xenon gas at 300° Kelvin is approximately 200 Torr. The distance between the tip of the electrode 4 and the nearest internal end of the discharge tube 3 is approximately 20 mm. The distance between the tip of the electrode 5 and the nearest internal end of the tube 3 is likewise approximately 20 mm. The power of the described lamp is approximately 400 Watts.

The arrangement shown in FIG. 1 operates as follows. Firstly the switch 10 is set to the position at which terminal 1 is connected to contact 12. Subsequently the terminals 1 and 2 are connected to the voltage source of 38 Volt. As a result a current starts to flow in the circuit 1, 10, 12, 13, 14, 2. The heat which is thereby evolved in the heating filament 14 brings the discharge tube 3 to a higher temperature. If the temperature of the coldest spot - that is to say, of a spot which in high pressure discharge tubes is located in general behind the electrode 4 and behind the electrode 5 - i.e. in the relevant case at the area of the heat shields 18 and 19 - has achieved a value of between 500° C and 675° C, the switch 10 is changed over to the position at which terminal 1 is interconnected to contact 11. An auxiliary device not shown subsequently generates several peak voltages between the terminals 11 and 2. Then a current starts to flow in the circuit 1, 10, 11, 4, 5, 2. This is the discharge current of the lamp. In this situation the mean temperature of the discharge tube 3 is more than 2000° Kelvin. This means that the xenon pressure in the discharge tube 3, which is approximately 200 Torr at 300° Kelvin, is now approximately 1350 Torr in the operating condition. This means that this xenon pressure is above the required 600 Torr. In this situation the temperature of the coldest spot in the discharge tube is approximately 650° C which corresponds to a sodium pressure of approximately 50 Torr so that the ratio ($P_{sodium}/P_{xenon}$) = (50/1350) = 1/27) satisfies the requirement of less than or equal to 1/20.

Figure 2:
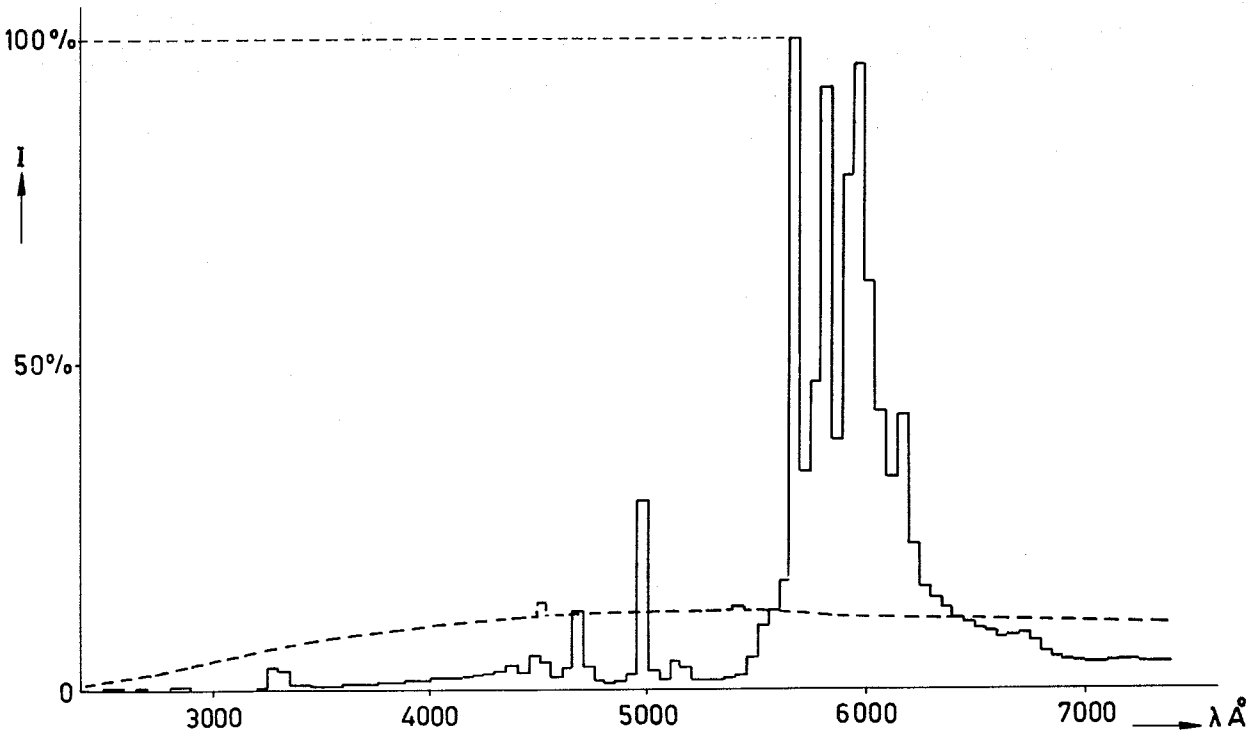
FIG. 2 shows the spectral distribution of the radiation emitted by the lamp of FIG. 1 and in addition a broken "curve"-line in this Figure indicates the spectral distribution of a lamp (not according to the invention) in which a discharge is effected in substantially pure xenon gas.

FIG. 2 shows the spectral distribution of the lamp of FIG. no. 1. The relative intensity I in percent is plotted against the wavelength λ in Angstrom. This is a spectral distribution as is found in highpressure sodium vapor discharge lamps. It is a spectral distribution closely enveloping the range of the maximum sensitivity of the eye. As a result the luminous efficacy of the lamp is large, in the relevant case approximately 110 lumens per Watt. A broken "curve"-line - calculated for the same total radiation - indicates the spectral distribution of a lamp (not according to the invention) with a discharge in substantially pure xenon gas. The luminous efficacy was lower than half that of the described lamp according to the invention.

What is claimed is:

1. A method for efficiently producing light which comprises:

providing a discharge lamp having a discharge tube, a pair of electrodes and a filling which mainly comprises sodium and xenon and wherein in the operating condition of said lamp the pressure of the xenon is less than 600 Torr and the ratio between the pressure of the sodium and the pressure of the xenon is less than or equal to 0.05 and at least a part of said sodium is non-volatilized during operation of said lamp;

providing means disposed about the outer surface of said discharge tube for heating the interior of said discharge tubes;

controlling the temperature in said discharge tube at the coolest spot therein to between 500° C and 675° C before initiation of the discharge and then initiating and continuing a discharge in said discharge tube without any ballast.

2. A method as described in claim 1 wherein a step of providing a discharge lamp includes providing a discharge tube having a heat shield disposed within said discharge tube and generally about each electrode.

3. A method as described in claim 1 wherein said step of providing a discharge lamp includes providing a discharge lamp having a cooling fin disposed within said discharge tube and generally about each electrode.

4. A method as described in claim 1 wherein said step of providing means for heating includes providing a heating coil which generates heat responsive to flow of current therein.

5. A method as described in claim 4 wherein said step of providing means for controlling includes providing a switch which connects electric power intermitantly.

* * * * *

UNITED STATES PATENT OFFICE

CERTIFICATE OF CORRECTION

Patent No. 4,039,880 Dated August 2, 1977

Inventor(s) Louis B. Beyer et al

It is certified that error appears in the above-identified patent and that said Letters Patent are hereby corrected as shown below:

Column 4, claim 1, line 7, "less" should be -- more --.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*